US007419037B2

(12) United States Patent
Nordstrom

(10) Patent No.: US 7,419,037 B2
(45) Date of Patent: Sep. 2, 2008

(54) EQUIPMENT CARRIER WITH A ROTATABLE HANDLE

(75) Inventor: Mark Nordstrom, Brentwood, TN (US)

(73) Assignee: TRG Accessories, LLC, St. Lous, MO (US)

( * ) Notice: Subject to any disclaimer, the term of this patent is extended or adjusted under 35 U.S.C. 154(b) by 392 days.

(21) Appl. No.: 10/885,264

(22) Filed: Jul. 6, 2004

(65) Prior Publication Data

US 2006/0006034 A1 Jan. 12, 2006

(51) Int. Cl.
*A45C 7/00* (2006.01)
*A45C 5/14* (2006.01)
*A45C 13/20* (2006.01)

(52) U.S. Cl. ..... 190/107; 190/18 A; 190/39; 190/115; 206/315.1; 280/37

(58) Field of Classification Search ..... 190/15.1, 190/39, 115, 127, 116–118, 18 A, 18 R, 37, 190/107; 280/37; 16/113.1, 409, 408, 114.1; 220/766, 770; 206/315.1; 150/159
See application file for complete search history.

(56) References Cited

U.S. PATENT DOCUMENTS

| | | | | | |
|---|---|---|---|---|---|
| 959,235 | A | | 5/1910 | Lemieux | |
| 1,111,426 | A | * | 9/1914 | Aronoff | 292/75 |
| 1,624,714 | A | * | 4/1927 | Bullock | 190/19 |
| 2,714,012 | A | | 7/1955 | Berger | |
| 2,902,287 | A | | 9/1959 | Elias | |
| 3,522,955 | A | | 8/1970 | Wamer | |
| 3,697,095 | A | | 10/1972 | Howell | |
| 3,709,513 | A | * | 1/1973 | Cassimally | 280/37 |
| 3,960,252 | A | * | 6/1976 | Cassimally | 190/18 A |
| 4,117,914 | A | | 10/1978 | Snyder | |
| 4,118,048 | A | | 10/1978 | Spranger et al. | |
| 4,220,343 | A | * | 9/1980 | Robinson | 280/33.998 |
| 4,299,313 | A | | 11/1981 | Null | |
| 4,358,006 | A | | 11/1982 | Castelli | |
| 4,375,847 | A | * | 3/1983 | Picco | 206/315.2 |
| 4,522,299 | A | * | 6/1985 | Clark et al. | 206/315.3 |
| 4,538,709 | A | | 9/1985 | Williams et al. | |
| 4,544,050 | A | | 10/1985 | Seynhaeve | |
| 4,575,109 | A | * | 3/1986 | Cowdery | 280/37 |
| 4,775,072 | A | * | 10/1988 | Lundblade et al. | 220/766 |

(Continued)

FOREIGN PATENT DOCUMENTS

| | | |
|---|---|---|
| DE | 0187318 | 12/1985 |

(Continued)

*Primary Examiner*—Sue A Weaver
(74) *Attorney, Agent, or Firm*—Armstrong Teasdale LLP

(57) ABSTRACT

An equipment bag includes a body having a cavity with an opening for placement of items within the cavity and a rigid side opposite the opening. The rigid side is defined by opposite end edges and opposite side edges extending between the end edges, and the rigid side comprises an exterior recess therein located at a distance from each of the end edges and the side edges. A handle is pivotally mounted in the recess and movable between a stowed position substantially flush with an outer surface of the rigid side and a pulling position extending outward from the recess. By distancing the handle from the edges of the bag, an angle of inclination of the bag with respect to the ground is increased when the bag is pulled with the handle.

14 Claims, 8 Drawing Sheets

U.S. PATENT DOCUMENTS 4,832,362 A 5/1989 Chen
4,838,396 A 6/1989 Krenzel
4,890,856 A * 1/1990 Mursch et al. ..... 280/646
4,928,800 A 5/1990 Green et al.
4,966,259 A 10/1990 Bergman
4,974,871 A 12/1990 Mao
5,075,925 A * 12/1991 Maloney ..... 16/113.1
D335,030 S * 4/1993 Alfonso ..... D3/279
5,249,438 A 10/1993 Rhaney et al.
5,277,449 A * 1/1994 Schmidt ..... 280/655
5,291,976 A 3/1994 Ku
5,330,037 A 7/1994 Wang
5,350,046 A 9/1994 Falloon et al.
5,371,923 A 12/1994 Chang
5,428,868 A * 7/1995 Safdeye et al. ..... 16/113.1
5,433,230 A * 7/1995 Miller ..... 134/110
5,458,020 A 10/1995 Wang
5,464,080 A 11/1995 Liang
5,469,945 A 11/1995 Jserng
5,470,095 A 11/1995 Bridges
5,494,157 A 2/1996 Golenz et al.
5,524,737 A * 6/1996 Wang ..... 190/18 A
5,533,601 A 7/1996 Wang
5,542,510 A 8/1996 Rekuc et al.
5,547,053 A 8/1996 Liang
5,553,350 A 9/1996 Chang
5,553,692 A 9/1996 Sheiman
5,562,189 A 10/1996 Chen
5,564,538 A 10/1996 Sadow
5,573,089 A 11/1996 Liang
5,575,362 A 11/1996 Franklin et al.
5,588,569 A * 12/1996 Mitomi et al. ..... 224/153
5,630,521 A 5/1997 Waddell et al.
5,689,854 A 11/1997 Wang
5,690,196 A 11/1997 Wang
5,713,441 A 2/1998 Chen
5,722,118 A 3/1998 Hansen et al.
5,722,518 A 3/1998 Aumasson
5,765,691 A * 6/1998 Hall ..... 206/579
5,791,014 A 8/1998 Wong
5,803,472 A 9/1998 Lien
5,868,247 A * 2/1999 Schrader ..... 206/315.4
5,890,570 A 4/1999 Sadow
5,934,425 A 8/1999 Sadow
5,943,936 A 8/1999 Deliman et al.
5,970,579 A 10/1999 Lu
5,984,064 A 11/1999 Byington
6,056,301 A 5/2000 Berliner et al.
6,065,574 A 5/2000 Miyoshi
6,148,971 A 11/2000 Kho
6,158,762 A 12/2000 Wong
6,164,425 A * 12/2000 Latshaw ..... 190/18 A
6,186,522 B1 * 2/2001 Weis ..... 280/37
6,213,267 B1 4/2001 Miller
6,330,944 B1 * 12/2001 DeMichele ..... 206/315.3
6,449,993 B2 * 9/2002 Elliott et al. ..... 70/63
6,478,203 B2 * 11/2002 Burns ..... 224/510
6,612,412 B2 * 9/2003 Sanderson et al. ..... 190/18 A
6,634,496 B2 * 10/2003 Scoglio ..... 206/315.3
7,077,252 B2 * 7/2006 Sanchez ..... 190/108
7,188,714 B1 * 3/2007 Herold ..... 190/18 A
7,222,733 B2 * 5/2007 Kim ..... 206/315.3
2003/0000785 A1 1/2003 Miller et al.
2003/0079949 A1 5/2003 Harvey
2003/0084543 A1 5/2003 Sadow
2003/0132080 A1 * 7/2003 Dababneh ..... 190/115
2004/0065518 A1 * 4/2004 Hoberman ..... 190/107
2004/0134811 A1 * 7/2004 Lai ..... 206/315.3
2005/0034947 A1 * 2/2005 Nykoluk ..... 190/18 A
2005/0167221 A1 * 8/2005 Mohr et al. ..... 190/23

FOREIGN PATENT DOCUMENTS

GB 2111465 A * 7/1983
WO WO 93/24029 * 12/1993

* cited by examiner

EQUIPMENT CARRIER WITH A ROTATABLE HANDLE

BACKGROUND OF THE INVENTION

This invention relates generally to athletic equipment bags for being carried by a person and, more particularly, to athletic equipment carriers having a handle to transport the carrier in an inclined position on a ground surface.

While a variety of sports and recreational activities are ever increasing in popularity, stowing and transporting equipment to and from the sporting event or area of activity can be a drawback to an otherwise enjoyable experience. Traditionally, athletic equipment, such as golf bags and clubs, hockey gear, baseball bats and equipment, basketballs or soccer balls, and other types of sporting equipment are carried around in an equipment bag and laid on the ground when the user or users arrive at their destination. Picking up the bag and laying it down repeatedly, not to mention carrying a heavy load of equipment, can be tiresome and inconvenient. While carrying straps are typically provided, most equipment bags are uncomfortable to carry.

Wheeled bags and the like are sometimes used to transport the equipment, such as a golf bag, and the wheels allow the equipment bags to be pulled along a surface rather than being carried above the ground. Known equipment bags, however, are disadvantaged in several aspects. For example, some wheeled equipment bags are typically pulled or supported from a handle located on an end of the bag opposite the wheels, and consequently a significant portion of the weight of the equipment bag is supported by the user gripping the handle. Additionally, the weight of an equipment bag when fully loaded necessitates a sturdy handle construction which only adds to the weight of the golf bag. Further, incorporating extendable telescoping handles and the like in a large equipment bag capable of accommodating large athletic equipment, including but not limited to golf bags, can be a difficult and expensive proposition. Moreover, some known handles are attached to the exterior of the equipment bag and are subject to a variety of external elements and forces while the equipment bag is being handled which could damage or even break the handle.

BRIEF DESCRIPTION OF THE INVENTION

According to an exemplary embodiment, a piece of baggage comprises a body comprising a cavity having an opening for placement of items within the cavity and a rigid side opposite the opening. The rigid side is defined by opposite end edges and opposite side edges extending between the end edges, and the rigid side comprises an exterior recess therein located at a distance from each of the end edges and the side edges. A handle is pivotally mounted in the recess and movable between a stowed position substantially flush with an outer surface of the rigid side and a pulling position extending outward from the recess.

According to another exemplary embodiment, an equipment bag is provided. The equipment bag comprises a body defining a cavity configured to store athletic equipment, and the body comprising at least one planar side defined by opposite end edges and opposite side edges extending between the end edges. The planar side comprises a recess therein having a depressed surface relative to an outer surface of the planar side, and a handle is pivotally mounted in the recess and has a depth approximately equal to a depth of the recess. The handle is movable between a stowed position substantially flush with an outer surface of the planar side and a pulling position extending outward from recess.

In yet another embodiment, a golf bag carrier for transporting a golf bag and golf clubs therein is provided. The carrier comprises a body defining an elongated cavity configured to receive the golf bag and clubs, the body comprising at least one planar side defined by opposite end edges and opposite side edges extending between the end edges. The planar side comprises a recess therein having a depressed surface relative to an outer surface of the planar side, and a handle is pivotally mounted in the recess and has a depth approximately equal to a depth of the recess. The handle is movable between a stowed position substantially flush with an outer surface of the planar side and a pulling position extending outward from recess. The handle is exposed on the planar side in each of the stowed position and the pulling position, and wheels are coupled to the body for engaging a supporting surface when the carrier is pulled with the handle.

DETAILED DESCRIPTION OF THE INVENTION

Figure 1:
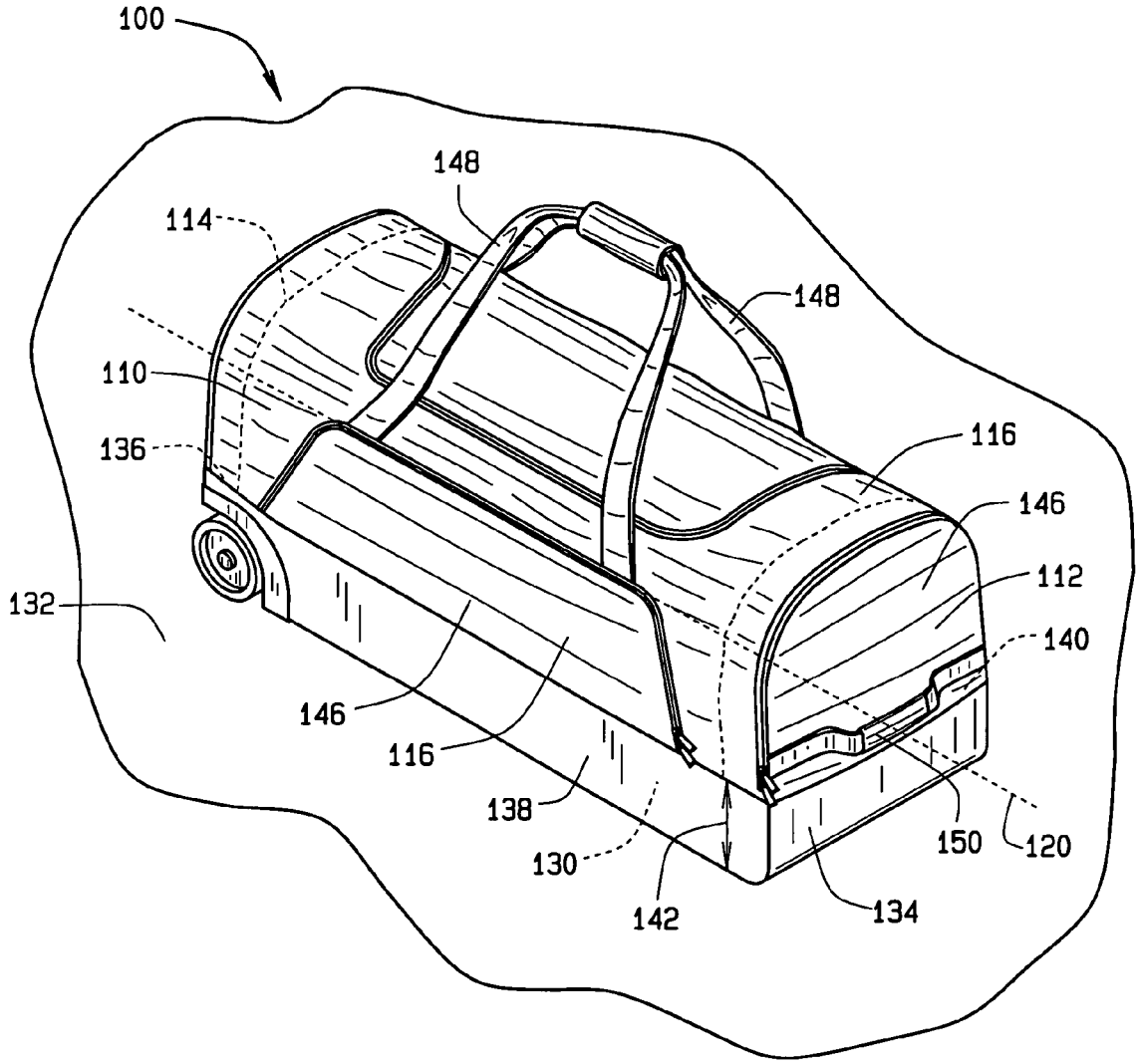
FIG. 1 is a top perspective view of an equipment bag according to an exemplary embodiment of the present invention.

FIG. 1 illustrates a top perspective view of an equipment bag or equipment carrier 100 formed in accordance with an exemplary embodiment of the invention. In the illustrative embodiment, the equipment bag 100 is configured for carrying oversized athletic equipment which may not be accommodated in conventional luggage bags due to size and weight constraints. It is understood that the invention can be utilized in and for a variety of athletic endeavors, including, but not limited to, bags for transporting hockey gear, ball bags (e.g. baseballs, soccer balls and basketballs), and other items associated with athletic and recreational activity. It is appreciated that the benefits and advantages of the invention may occur in a variety of equipment carriers, and while the invention is described and illustrated in the context of exemplary athletic equipment carriers, the invention is not intended to be limited thereto.

Figure 3:
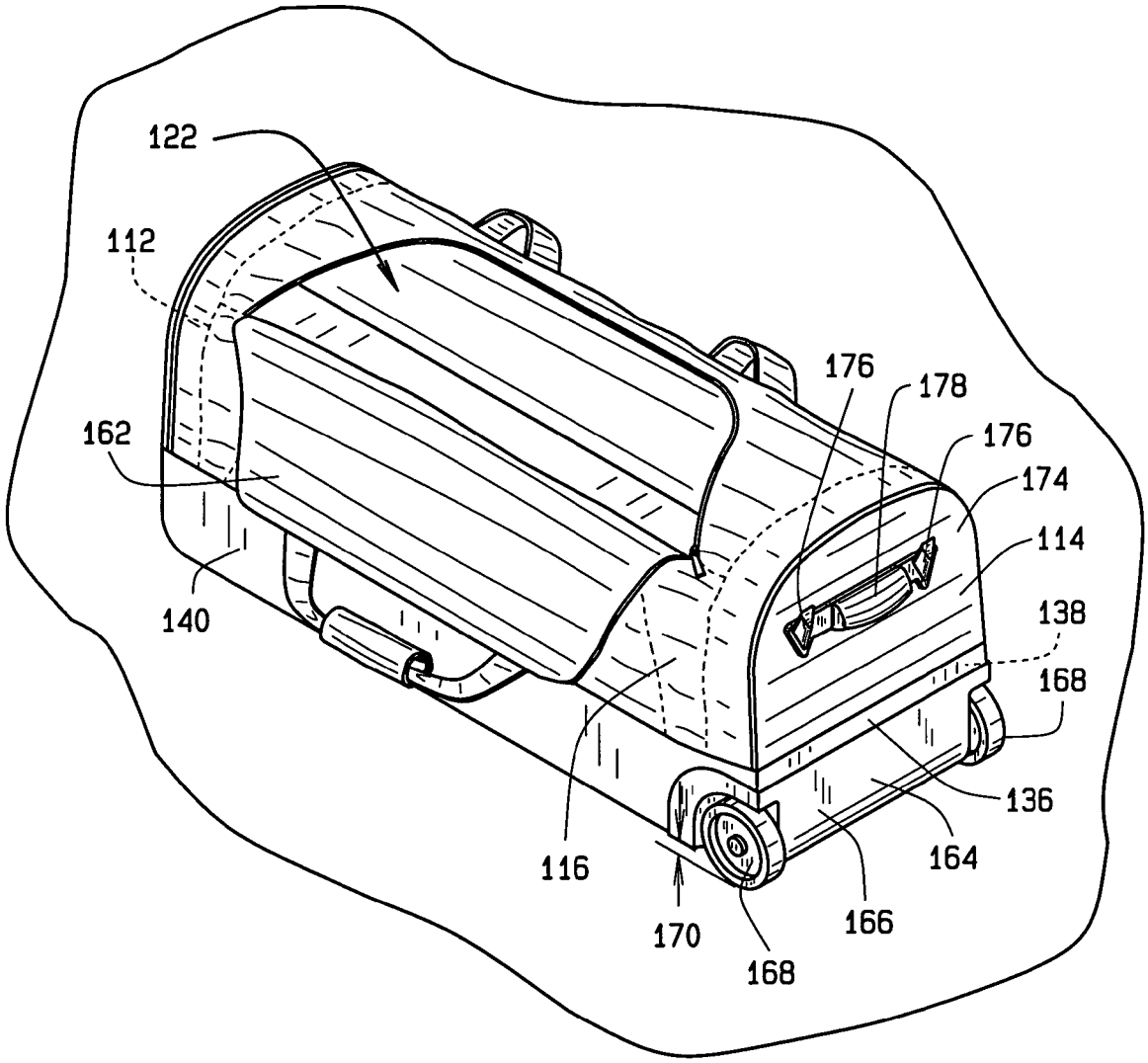
FIG. 3 is another bottom perspective view of the equipment bag shown in FIGS. 1 and 2.

In an illustrative embodiment, the equipment bag 100 includes an elongated body 110 having a generally rectangular shape with opposing top and bottom ends 112 and 114, respectively. The body 110 also includes a plurality of side walls 116 extending from the top end 112 to the bottom end 114 along a longitudinal axis 120 of the equipment bag 100. The ends 112 and 114 and side walls 116 define a cavity 122, as shown in FIG. 3, for housing oversized and/or bulky items that a user needs to transport, such as, for example, athletic equipment including but not limited to athletic and leisure equipment such as hockey equipment, soccer equipment, basketball equipment, baseball equipment, golf gear and the like.

Figure 2:
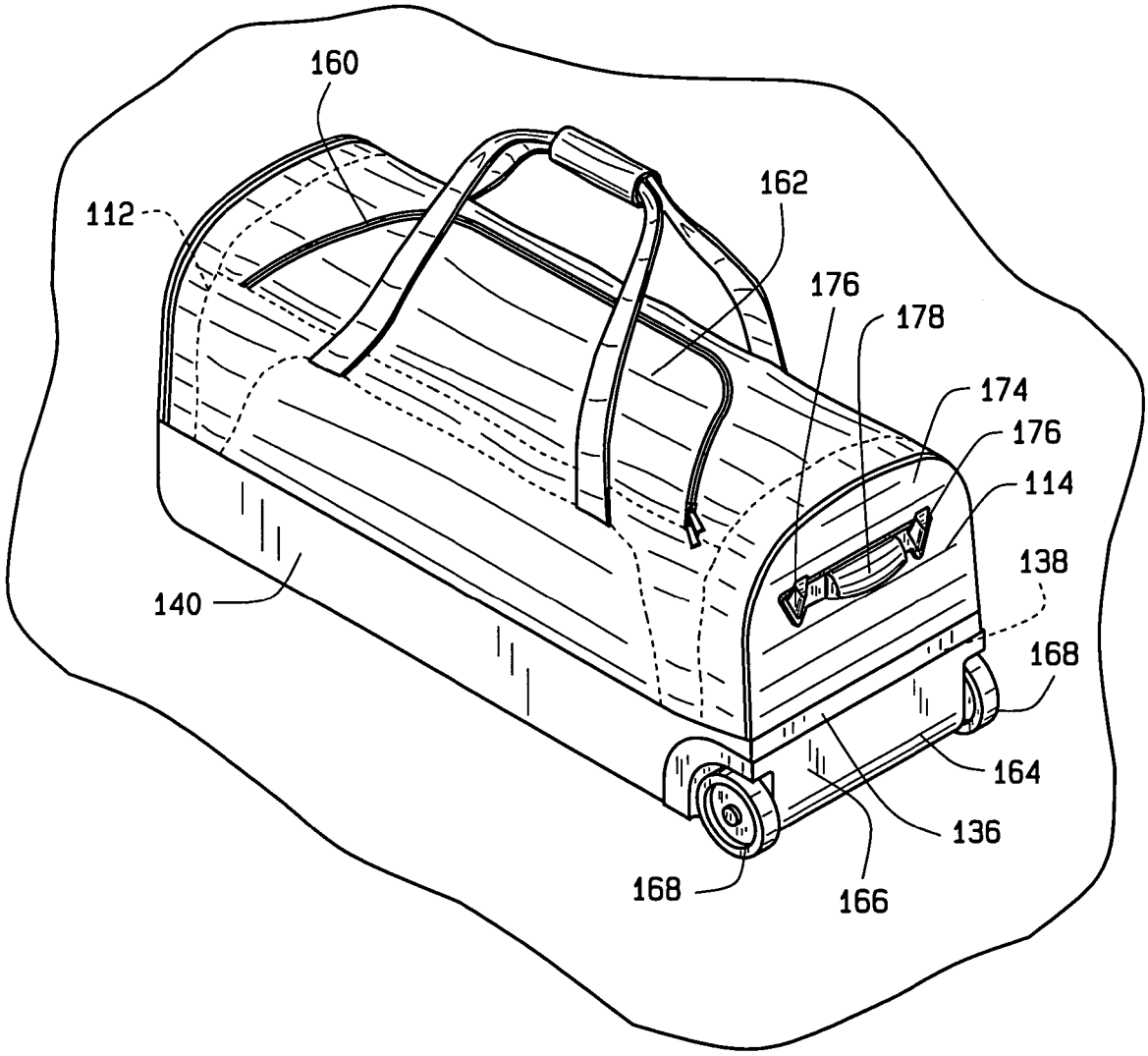
FIG. 2 is a bottom perspective view of the equipment bag shown in FIG. 1.

In an exemplary embodiment, the equipment bag 100 includes a back wall 130 which is at least partially fabricated from a rigid material, such as, for example, molded plastic. The rigid back wall 130 has a generally flat or planar outer surface which is generally placed upon a supporting surface 132 when the equipment bag 100 is in a resting position, as shown in FIGS. 1-3. In an exemplary embodiment the back wall 130 includes opposite top and bottom end edges 134 and 136, respectively, and opposite side wall edges 138 and 140 that extend upward from the back wall 130 for a specified distance 142. The edges 134, 136, 138, and/or 140 provide stability to the equipment bag 100 when the equipment bag 100 is in the resting position and also provide protection to the equipment bag 100 and the contents of the equipment bag 100 when the equipment bag 100 is being transported. It is appreciated, however, that in alternative embodiments the side wall edges 138 and 140 need not be employed.

In an exemplary embodiment, the side walls 116 are collapsible and are fabricated from a flexible material, such as, by way of example only, canvas or nylon materials. The collapsible side walls 116 allow the equipment bag 100 to fold or gather when the equipment bag 100 is emptied so that the equipment bag 100 can be stored while occupying a reduced amount of storage space when not in use. It is contemplated, however, that in alternative embodiments the side walls 116 need not be collapsible, whether because the side walls 116 are fabricated from rigid or semi-rigid materials themselves or because the bag 100 includes an internal frame or stiffener elements to maintain a desired shape or form of the bag 100, whether loaded or unloaded.

The side walls 116 include a plurality of pockets 146, or pouches, that provide storage for additional items that do not fit, or alternatively, need to be separated from the items placed in the cavity 122. In an exemplary embodiment, a plurality of carrying straps 148 are coupled to the side walls 116 opposite the back wall and are capable of being coupled to one another when carrying the equipment bag 100. Moreover, a hand grip 150 is coupled to the top end 112 of the equipment bag 100 which aids in carrying, lifting or transporting the equipment bag 100. In an alternative embodiment, the carrying straps 148 and/or the hand grip 150 are coupled to the rigid back wall 130.

As shown in FIGS. 2 and 3, the collapsible side walls 116 of the equipment bag 100 include a zipper member 160 extending around a flap portion 162 of the collapsible side wall 116. The flap portion 162 is movable between an open position and a closed position. When the equipment bag 100 is in the closed position, the items contained within the equipment bag 100 are secured within the cavity 122. When the equipment bag 100 is in the open position, the cavity 122 is exposed and athletic equipment can be inserted into or removed from the equipment bag 100.

A rigid wheel casing 164 is coupled to the rigid back wall 130 proximate to the bottom end 114. The wheel casing 164 includes a rigid member 166 extending the width of the bottom end 114 of the equipment bag 100, and a pair of wheels 168 rotatably coupled to the rigid member 166. In an exemplary embodiment, the wheels 168 extend a distance 170 (FIG. 3) beyond the back wall 130 and contact the supporting surface 132 when the equipment bag 100 is in the resting position. Accordingly, the back wall 130, proximate to the wheel casing 164, is slightly elevated such that the back wall 130 does not contact the supporting surface 132 when the equipment bag 100 is being pulled with the wheels 168 rolling along a supporting surface 132.

Figure 4:
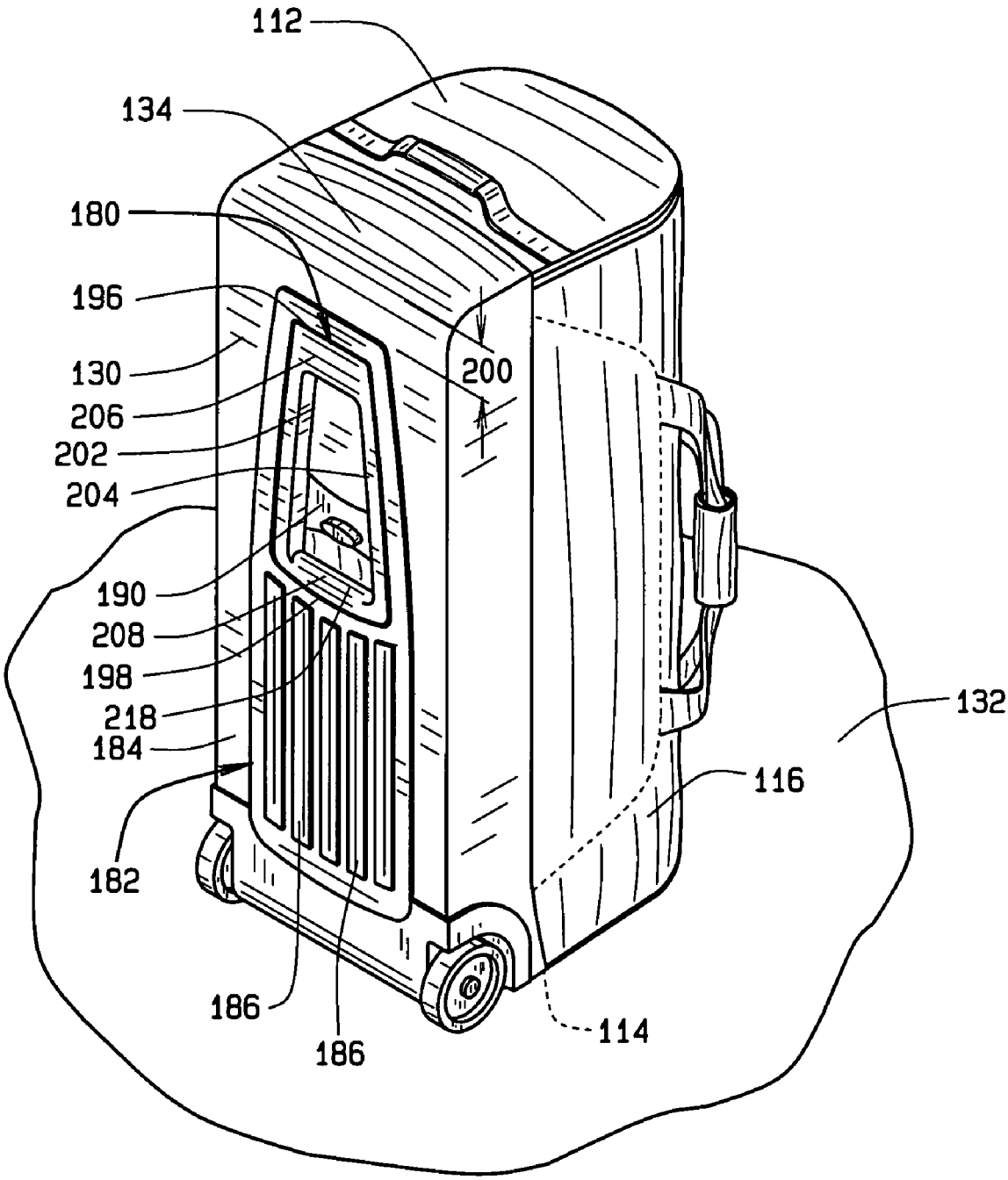
FIG. 4 is a side perspective view of the equipment bag shown in FIGS. 1-3, in an upright position showing an exemplary handle for use with the bag.
Figure 5:
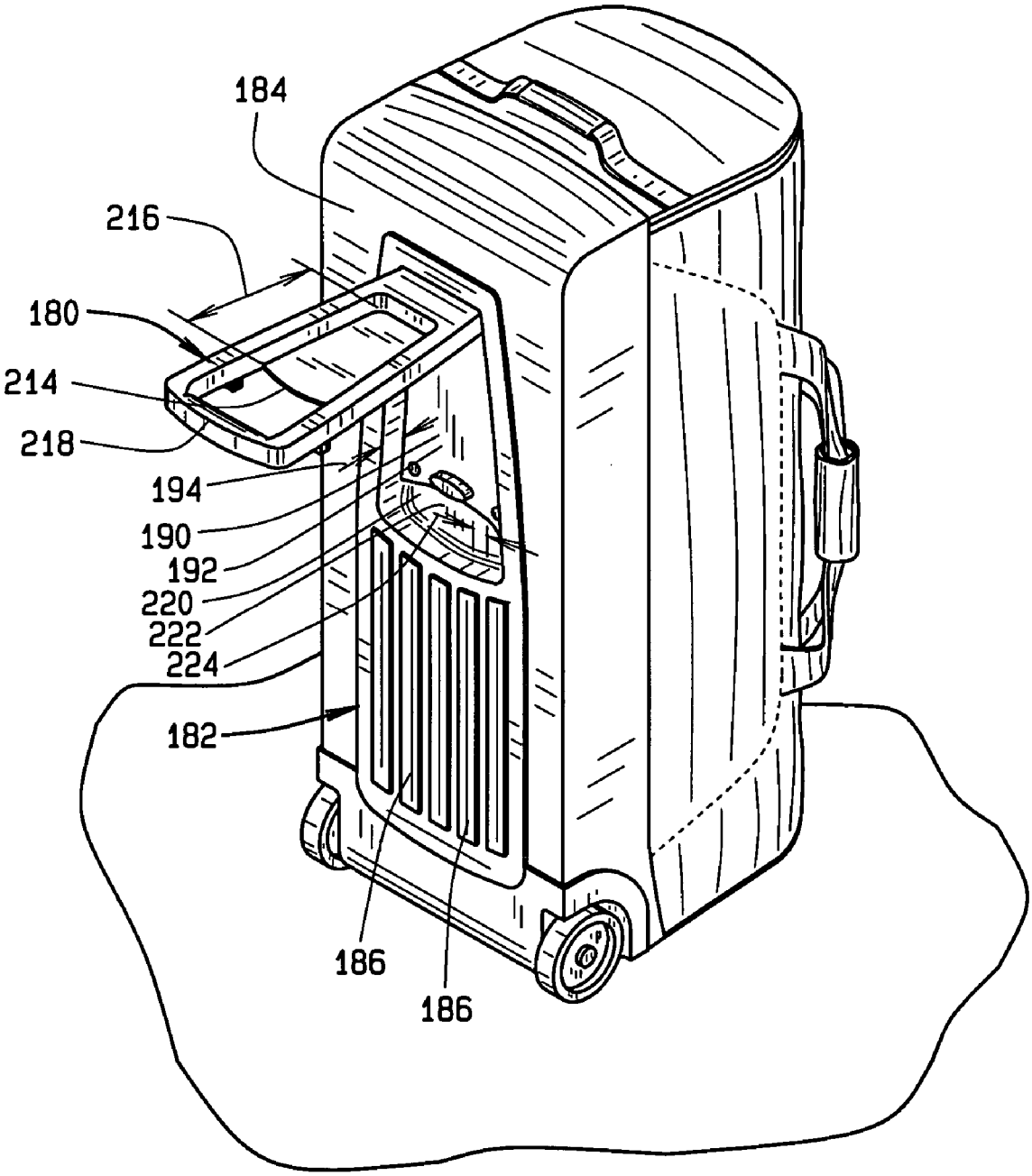
FIG. 5 is another side perspective view of the equipment bag shown in FIGS. 1-4, showing the handle in an extended position.

In an exemplary embodiment, the bottom end 114 includes a rigid flap 174 that extends from the bottom end edge 136 of the back wall 130. The rigid flap 174 includes a plurality of foot elements 176 and a hand grip 178 extending from the bottom end 114. The foot elements 176 contact the supporting surface 132, and support the equipment bag 100 to prevent the bag 100 from tipping when the equipment bag 100 is in an upright or standing position, as shown in FIGS. 4 and 5. The hand grip 178 aids a user in carrying, lifting or transporting the equipment bag 100.

Figure 6:
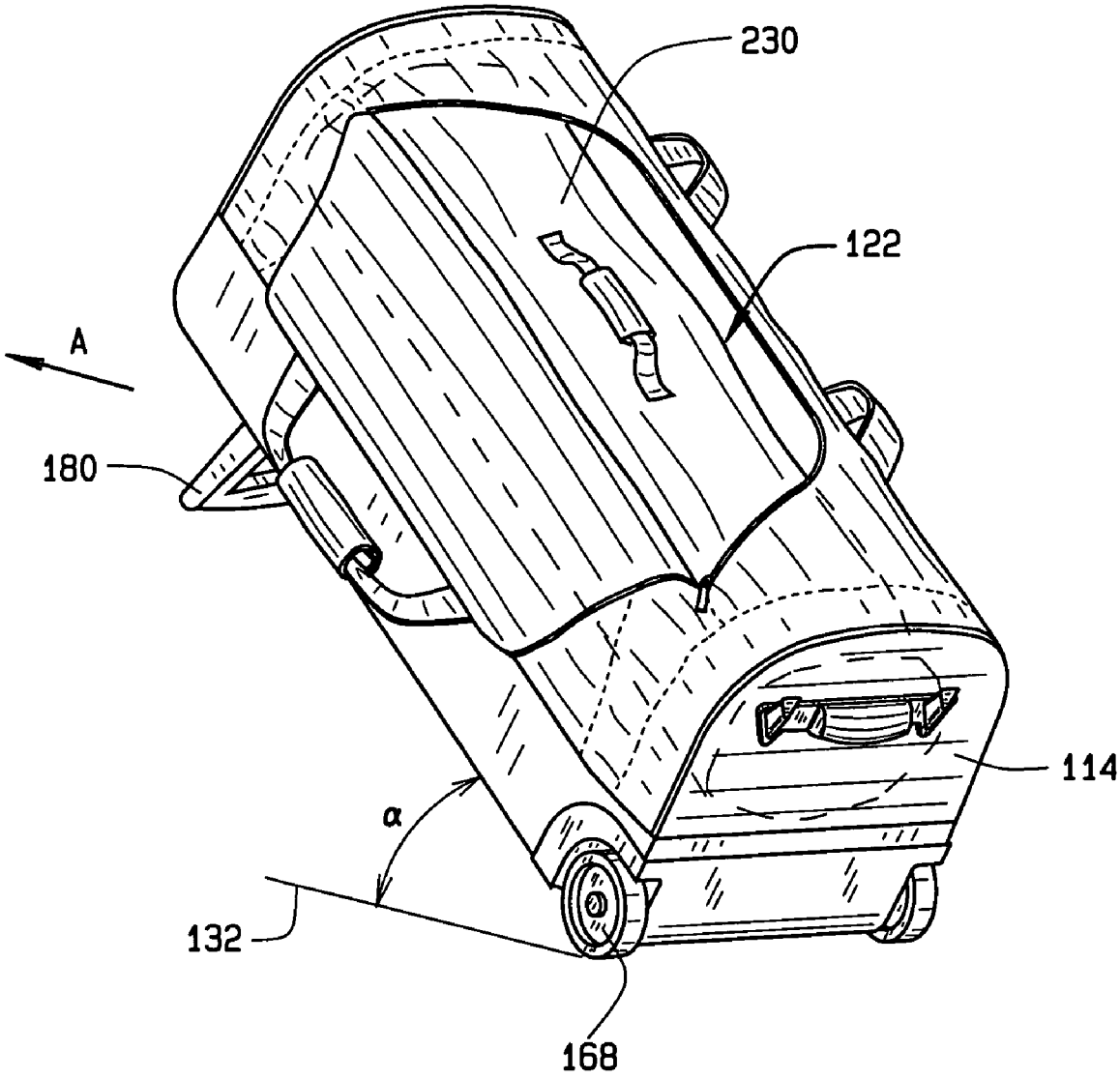
FIG. 6 is a perspective view of the equipment bag shown in FIGS. 1-5 in a pulling position.

FIGS. 4 and 5 illustrate the equipment bag 100 in the standing position showing an exemplary towing handle 180 in a stowed position and a pulling position, respectively, and FIG. 6 illustrates the bag 100 in a towing orientation. When the equipment bag 100 is in the standing position, the bottom end 114 of the equipment bag 100 is in contact with the supporting surface 132. Specifically, in an exemplary embodiment, the wheels 168 and the foot elements 176 (see FIGS. 2 and 3) of the equipment bag 100 support the equipment bag 100 in the standing position. In use, when the equipment bag 100 is being transported, the equipment bag 100 is inclined so that the equipment bag 100 has an angle of inclination $\alpha$ (FIG. 6) with respect to the supporting surface 132 and the bottom end 114 of the equipment bag 100 is elevated so that the equipment bag 100 can be pulled via the handle 180 along the supporting surface 132.

The back wall 130 includes a skid plate 182 extending along an outer surface 184 of the back wall 130 at least partially between the end edges 134 and 136 and the side wall edges 138 and 140 of the back wall 130. In an exemplary embodiment, the skid plate 182 includes a plurality of ridges 186 extending longitudinally along the skid plate 182, and a central recess 190 located within the skid plate 182 at a distance from each of the end edges 134 and 136 and the side wall edges 138 and 140. The plurality of ridges 186 elevate the planar back wall 130 from the supporting surface 132 and protect the back wall 130 from wear and damage from external forces when the equipment bag 100 is being transported. Accordingly, the ridges 186 are fabricated from a durable, rigid material, such as, for example, molded plastic.

The recess 190 is integrally formed with the skid plate 182 and has a depressed surface 192 that is recessed a distance 194 (FIG. 5) from the outer surface 184 of the rigid side wall 130. The recess 190 houses and protects the handle 180 when the handle 180 is in the stowed position. The recess 190 has an upper end 196 that corresponds to the top end 112 of the equipment bag 100 and a lower end 198 that corresponds to the bottom end 114 of the equipment bag 100. The recess 190 is located a distance 200 from the top end 112 of the equipment bag 100 which increases, compared to known wheeled equipment bags, the angle of inclination $\alpha$ (FIG. 6) of the equipment bag 100 with respect to the supporting surface 132 when the equipment bag 100 is pulled by a user. More specifically, when a person of a given height grips the handle 180 in the pulling position, the angle of inclination $\alpha$ (FIG. 6) with respect to the supporting surface 132 is greater than it would otherwise be if the user gripped a handle on the top end 112 of the equipment bag 100. As a result, the equipment bag 100 is pulled with the handle 180 along the supporting surface 132 in a more upright position, and consequently more of the weight of the equipment bag 100 is supported by the wheels 168, and less of the weight of the equipment bag 100 is supported by the user.

The handle 180 includes first and second longitudinal sides 202 and 204, respectively, and first and second lateral sides 206 and 208, respectively. The longitudinal sides 202 and 204 extend between the first and second lateral sides 206 and 208 generally along the longitudinal axis 120 of the equipment bag 100 and, in an exemplary embodiment, are angled with respect to the longitudinal axis 120. The lateral sides 206 and 208 extend between the longitudinal sides 202 and 204 and are generally disposed at the respective ends of the longitudinal sides 202 and 204. A support plate 214 is positioned between the longitudinal sides 202 and 204 and extends a distance 216 from the first lateral side 206. The support plate 214 provides support to the handle 180 between the longitudinal sides 202 and 204. The handle 180 is pivotably mounted to the rigid side wall 130 and is movable between the stowed position, as shown in FIG. 4, and the pulling position, as shown in FIG. 5. In the stowed position, the handle 180 is exposed to the exterior of the rigid side wall 130, and is substantially flush with the outer surface 184 of the rigid side wall 130, which protects the handle 180 from bending forces when the equipment bag 100 is being handled, such as when the equipment bag 100 is being inserted or removed from a vehicle, or when the equipment bag 100 is being placed on the supporting surface 132 in the resting position.

In an exemplary embodiment, the first lateral side 206 of the handle 180 is pivotably mounted within the recess 190 at the upper end 196 of the recess 190. The second lateral side 208 of the handle 180 includes a hand grip 218 that faces the bottom end 114 of the equipment bag 100 when the handle 180 is in the stowed position. In an exemplary embodiment, the handle 180 is lockable in the stowed position to protect the handle 180 from being damaged by inadvertently extending out of the recess 190, thereby being exposed to external elements and forces. The second lateral side 208 of the handle 180 can be rotatably removed from the recess 190 to the pulling position for towing the equipment bag 100. When the handle 180 is in the pulling position, as shown in FIG. 5, the second lateral side 208 of the handle 180 is substantially parallel with the first lateral side 206 and the longitudinal sides 202 and 204 are substantially parallel with the supporting surface 132. In an exemplary embodiment, the recess 190 includes a grip area 220 that allows a users hand to wrap partially around the hand grip 218 of the handle 180 and remove the hand grip 218 from the recess 190. The grip area 220 has a smooth surface 222 and extends a distance 224 beyond the recess 190 towards the cavity 122 of the equipment bag 100.

Figure 7:
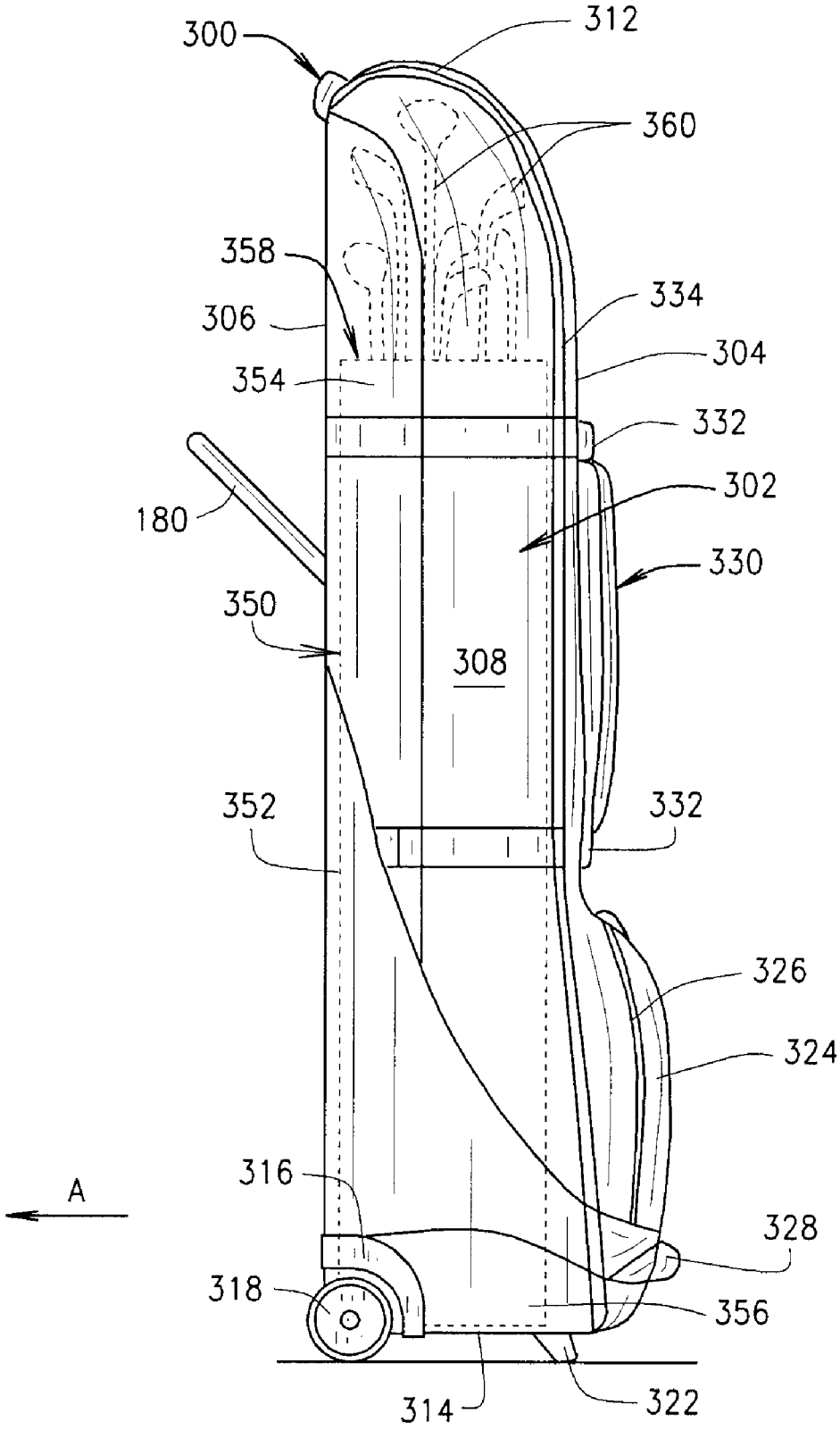
FIG. 7 is an side plan view of another embodiment of an equipment carrier.
Figure 8:
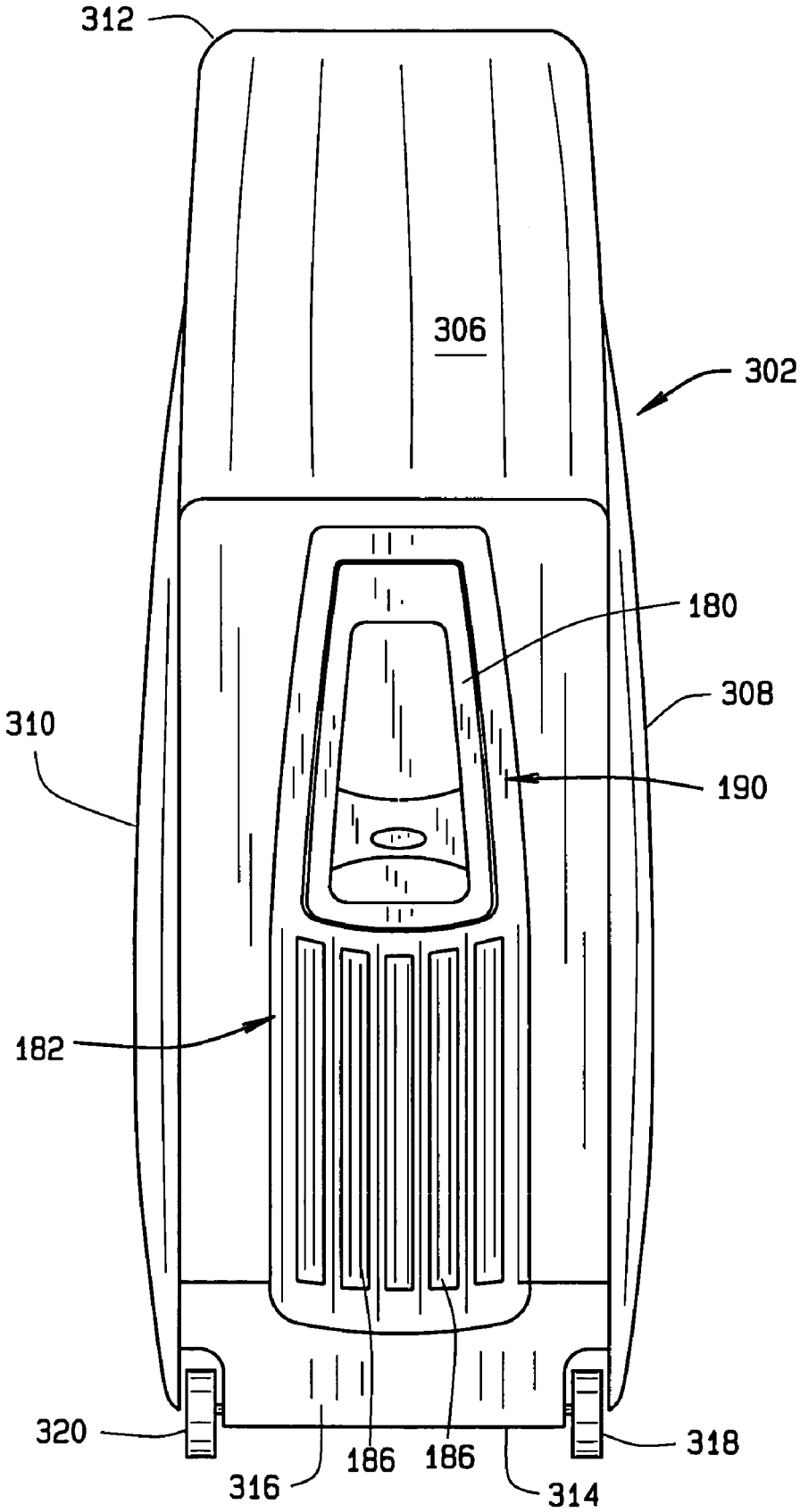
FIG. 8 is a rear plan view of the equipment bag shown in FIG. 6 in a pulling position.

FIGS. 7 and 8 are a side and rear plan view, respectively of another embodiment of an equipment bag or carrier 300, which is particularly suited for transporting oversized items such as a golf bag which may not be accommodated in general purpose bags, such as luggage bags and duffel bags commonly used by travelers to carry smaller items, such as, clothing items, personal items, and the like. The golf bag carrier 300 includes an elongated, flexible body 302 having a generally rectangular shape with opposing front and rear sides 304 and 306, opposing side portions 308 and 310, and opposing top and bottom portions 312 and 314 which in an exemplary embodiment are fabricated from a flexible or resilient material, yet generally maintain the shape of the carrier 300. Stiffeners and the like may be included internal to the body 302 to help maintain the overall shape of the carrier 300.

The bottom portion 314 has a rigid wheel casing 316 attached, located at the rear side 306 of the carrier 300. Attached to the wheel casing 316 is a pair of wheels 318 and 320 located on each side 308 and 310 of the carrier 300. The bottom portion 314 also has legs 322 which allow the golf bag carrier 100 to stand upright.

The front side 304 of the carrier 300 includes a storage pouch 324 located near the bottom portion 314. The storage pouch 324 is accessed through a storage pouch zipper member 326. The front portion 304 also includes a lower handle 328 at or near the bottom portion 314 of the carrier 300. The lower handle 328 is used to help a user to carry, lift, or move the carrier 300. The carrier 300 further includes a carrying strap assembly 330 which is located at or near the middle of the front portion 304, and carrying strap locking clips 332.

The front portion 304 is attached to the side portions 308 and 310 via a zipper member 334. More than one zipper member may be provided in varying configurations to define an opening to insert or remove a golf bag 350 (shown in phantom in FIG. 7) from the carrier 300 through the front side 304.

The golf bag 350 is but one example of an oversized item which may be stowed, transported and/or carried in the equipment carrier 300, and which, due to its size, shape, and weight, may not be accommodated in general purpose bags, such as luggage bags and duffel bags commonly used by travelers to carry smaller items, such as, clothing items, personal items, and the like. In an exemplary embodiment, the golf bag 350 includes an elongated body 352 having a longitudinal axis extending from an upper end 354 to a lower end 356 of the body 352. A compartment 358 extends between the ends 354 and 356, and the compartment 358 is sized and dimensioned to receive a set of golf clubs 360 therein. The golf clubs have heads positioned proximate the upper end 354 of the golf bag 350. The golf bag 350 may be inserted and fitted into a cavity defined by the body 302 of the carrier 300.

As shown in FIG. 7, the golf bag 350 is positioned within the body 302 of the carrier 300 such that the longitudinal axis of the golf bag 350 is substantially parallel with the longitudinal axis of the carrier 300. Moreover, the lower end 356 of the golf bag 350 is proximate to the bottom end 304 of the equipment bag 300 and the upper end 354 of the golf bag 350 and the golf club heads are positioned proximate to the top end 312 of the carrier 300.

The rear side 306 of the carrier 300 includes the skid plate 182 in a substantially planar region thereof, and the handle 180 is located in a recess 190 of the skid plate 182 substantially as described above with respect to FIGS. 1-6. In use, the carrier 300 is rotated from the standing position, as shown in FIG. 7, to a pulling position similar to the position shown in FIG. 6. In the pulling position, the user pulls the carrier 300 via the handle 180 in a direction of Arrow A with the wheels 318, 320 rolling on the supporting surface 132.

Like the bag 100, the handle 180 of the carrier 300 is located at a distance from the top end 312 of the carrier 300 which, unlike known wheeled bags having handles on the top side for pulling the bag, increases an angle of inclination with respect to the supporting surface 132 when the carrier 300 is being pulled. That is, for a person of a given height, the angle of inclination with respect to the supporting surface 132 when the user grips the handle 180 in the pulling position is greater than it would otherwise be if the user gripped a handle located on the top end 312 of the equipment bag 300 and pulled the equipment bag 100 in the direction of arrow A. Accordingly, the carrier 300 is easy to transport as the wheels 318 and 320 support more of the weight of the carrier 300, as opposed to the user having to support the weight. The benefits of having such a handle 180 are more readily appreciated as the size of equipment carried increases, and as the carrier 300 is larger than the bag 100 to accommodate the golf bag 350, the handle 180 significantly increases the comfort of the user pulling the carrier 300 while decreasing the effort required to do so. The carrier 300 may be utilized to store and transport large, heavy and/or bulky athletic equipment, such as a golf bag 350 and clubs 360, in a comfortable and convenient manner beyond the capability of known wheeled bags.

The above-described athletic equipment bags 100 and 300 provide a cost effective and reliable carrier for storing and transporting athletic equipment. The rotatable handle 180, as opposed to a more costly telescoping handle, may be used to store and transport the equipment bags 100 and 300 in a more comfortable and convenient manner than known bags. The rotatable handle 180 is housed within a central recess to more fully protect the handle 180 from inadvertent damage when the handle 180 is in the stowed position.

While the invention has been described in terms of various specific embodiments, those skilled in the art will recognize that the invention can be practiced with modification within the spirit and scope of the claims.

What is claimed is:

1. A piece of baggage comprising:

a body comprising a cavity having an opening for placement of items within the cavity and a rigid side opposite said opening, said rigid side defined by opposite end edges and opposite side edges extending between the end edges, said rigid side comprising an exterior recess therein located at a distance from each of the end edges and the side edges; and a handle pivotally mounted in said recess and movable between a stowed position substantially flush with an outer surface of said rigid side and a pulling position extending outward from said recess; and collapsible side walls coupled to said rigid side, the collapsible side walls folding on the rigid side and allowing storage of the piece of baggage in a reduced amount of space.

2. A piece of baggage in accordance with claim 1 wherein said handle comprises opposite longitudinal sides, said longitudinal sides angled with respect to one another.

3. A piece of baggage in accordance with claim 1 wherein said handle comprises first and second lateral sides spaced from one another, one of said first lateral sides rotatably coupled to said rigid side within said recess and the other of said lateral sides comprising a hand grip for pulling the piece of baggage.

4. A piece of baggage in accordance with claim 3 wherein said hand grip faces a bottom of said piece of baggage in the stowed position.

5. A piece of baggage in accordance with claim 1 wherein said recess is integrally formed in a skid plate.

6. A piece of baggage in accordance with claim 1 wherein said handle is exposed to an exterior of said rigid side when in the stowed position.

7. A piece of baggage in accordance with claim 1 further comprising a second rigid side oriented at substantially a 90° angle with said at least one rigid side, said second rigid side comprising foot elements wherein said piece of baggage is supportable in a standing position on said foot elements.

8. A piece of baggage in accordance with claim 1 further comprising wheels mounted to the rigid side.

9. A piece of baggage in accordance with claim 1 wherein said cavity is adapted for containing oversized athletic equipment.

10. A piece of baggage in accordance with claim 1 wherein said handle comprises opposite longitudinal sides and a support plate extending between the opposite longitudinal sides.

11. The piece of baggage in accordance with claim 1 wherein said recess is substantially centered between the end edges.

12. The piece of baggage in accordance with claim 1, wherein opposite end edges comprise a top end edge and a bottom end edge, and the handle in the pulling position does not extend above-the top end edge.

13. The piece of baggage in claim 1, wherein the handle is pivotally mounted at an end thereof and movable about 90° from the stowed position to the pulling position.

14. The piece of baggage in claim 1, wherein the handle is pivotally mounted at an end thereof and movable substantially more than 90° from the stowed position to the pulling position.

* * * * *